United States Patent [19]

Hishiki

[11] 4,095,206

[45] June 13, 1978

[54] ENCAPSULATED TRANSFORMER ASSEMBLY

[75] Inventor: Hideo Hishiki, Yokohama, Japan

[73] Assignee: Victor Company of Japan, Limited, Japan

[21] Appl. No.: 656,702

[22] Filed: Feb. 9, 1976

[30] Foreign Application Priority Data

| | | |
|---|---|---|
| Feb. 10, 1975 | Japan | 50-17103 |
| Apr. 4, 1975 | Japan | 50-40399 |
| Feb. 10, 1975 | Japan | 50-18977[U] |
| Feb. 10, 1975 | Japan | 50-18978[U] |

[51] Int. Cl.[2] ..... H01F 27/02; H01F 27/30

[52] U.S. Cl. ..... 336/96; 336/178; 336/192; 336/210

[58] Field of Search ..... 336/96, 192, 198, 208, 336/219, 210, 84, 178

[56] References Cited

U.S. PATENT DOCUMENTS

| | | | |
|---|---|---|---|
| 1,763,115 | 6/1930 | Wermine | 336/96 |
| 2,623,920 | 12/1952 | Ford | 336/219 |
| 2,930,011 | 3/1960 | Wigert et al. | 336/96 |
| 3,195,086 | 7/1965 | Taylor | 336/219 X |
| 3,240,848 | 3/1966 | Burke et al. | 336/96 X |
| 3,332,049 | 7/1967 | Hisano | 336/84 |
| 3,354,417 | 11/1967 | Davis | 336/96 |
| 3,522,569 | 8/1970 | Oechsle | 336/219 X |
| 3,566,322 | 2/1971 | Horbach | 336/198 X |
| 3,587,168 | 6/1971 | Kolator | 336/96 |
| 3,665,358 | 5/1972 | Leuck et al. | 336/96 |

FOREIGN PATENT DOCUMENTS

| | | | |
|---|---|---|---|
| 277,885 | 5/1966 | Australia | 336/96 |
| 840,020 | 4/1939 | France | 336/96 |
| 1,243,690 | 8/1971 | United Kingdom | 336/208 |

*Primary Examiner*—Thomas J. Kozma
*Attorney, Agent, or Firm*—Robert E. Burns; Emmanuel J. Lobato; Bruce L. Adams

[57] ABSTRACT

A transformer assembly comprising a core structure having an open space, primary and secondary coil units mounted either in parallel or in concentric relationship on the core structure, and a unitary insulating envelope of heat-resistant dielectric material such as silicon rubber, the insulating envelope a portion encapsulating the windings of the primary and secondary coil units and a portion occupying that area of the above mentioned open space which is subject to production of a corona discharge due to the high voltage to be developed in the secondary coil unit. The insulating envelope is formed by injecting the dielectric material of fluid state into a mould to which the subassembly of the core structure and coil units is fitted in part of in its entirety except for terminal elements. A partial vacuum is established in the mould so that the insulating envelope produced is void-free. The transformer is useful especially as a flyback transformer for use in a horizontal deflection circuit of a television receiver.

10 Claims, 26 Drawing Figures

Fig. 1
PRIOR ART
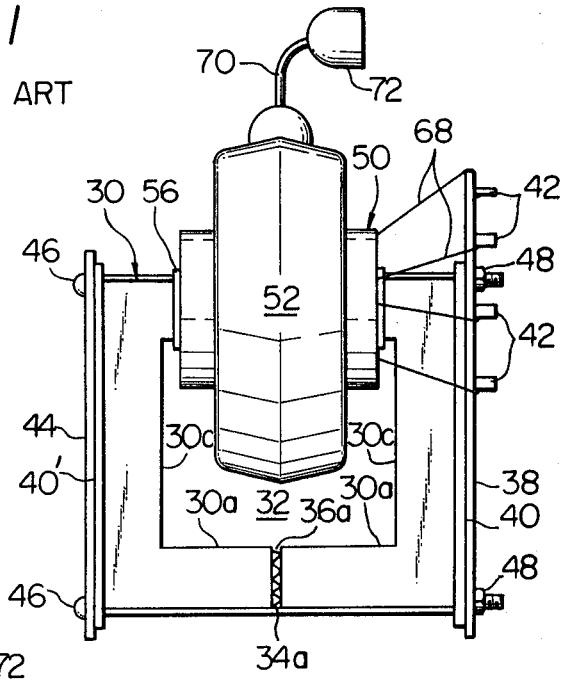
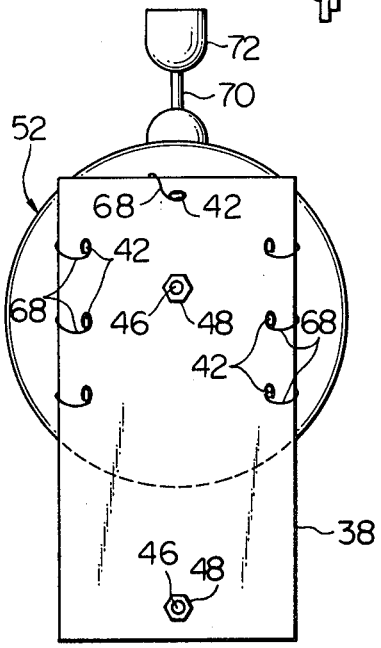
Fig. 2
PRIOR ART

Fig. 3
PRIOR ART
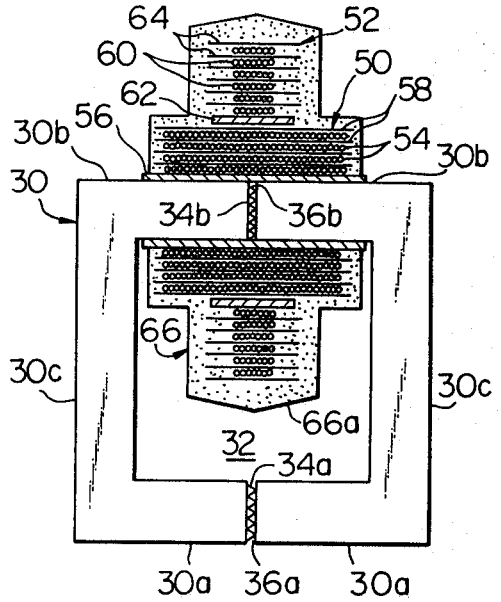
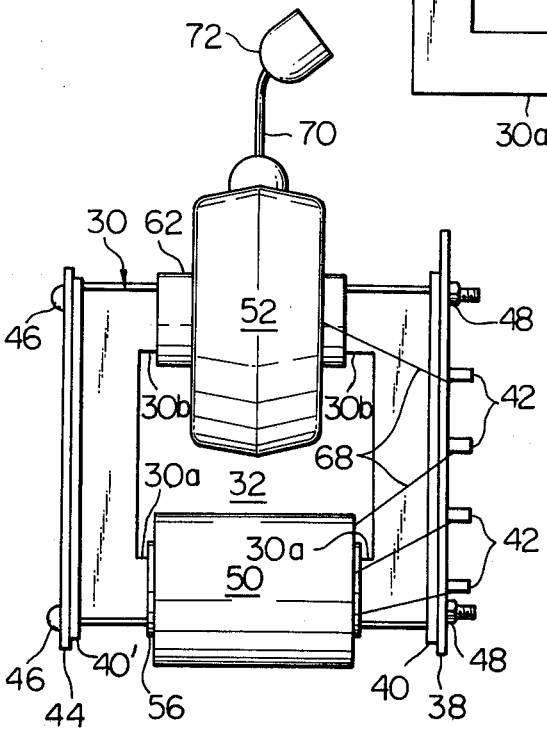
Fig. 4
PRIOR ART

ENCAPSULATED TRANSFORMER ASSEMBLY

BACKGROUND OF THE INVENTION

The present invention relates to improvements in transformers for use in electric circuits and to a method of manufacturing an improved transformer assembly.

While the principal features of the transformer assembly and the method according to the present invention may be incorporated into transformers for use in various types of electric devices and utilized for the manufacture of such transformers, the transformer assembly provided by the present invention will prove useful especially as a flyback transformer to be incorporated into the horizontal deflection circuit of a cathode-ray tube of a television receiver.

A flyback or horizontal deflection output transformer of a television receiver is used to produce a horizontal deflection current during the scanning period and to develop a high anode voltage of the cathode-ray tube from the pulse voltage induced in the primary circuit of the transformer during the flyback or retrace period.

To cope with the increasing requirement for the safety of operation and the reduction of the cost and size of a television receiver, there is a trend to have the flyback transformer installed on a printed circuit board together with various other circuit elements of the television receiver. Research and development efforts are thus being made in the art in an attempt to provide a flyback transformer which can be readily and securely mounted on a printed circuit board without taking up much space and affecting the performance characteristics of the electric elements located in the neighbourhood of the transformer.

While varying in detailed construction depending upon the types, sizes and desired performance characteristics, a flyback transformer generally has a magnetic circuit taking the form of a single ring encircled by two or more groups of primary and secondary windings which are distributed around the periphery of the ring, or ferromagnetic core. The primary and secondary windings are embedded in insulating envelopes of dielectric material such as a silicon resin filling the interstices between the adjacent windings and the layers of the windings and encapsulating the entire bodies of the windings. The primary and secondary windings or the secondary winding and an adjacent portion of the ferromagnetic core are thus spaced apart from each other through a dielectric layer of air that tends to produce a corona discharge. To prevent the production of a corona discharge between the electrodes thus constituted by the primary and secondary windings or the secondary winding and the adjacent portion of the core through such an air layer, it is important that the core be formed with a window which is large enough to accommodate a sufficiently large sized air layer or to permit the windings to be encased in sufficiently thick insulating envelopes. This results in increases in the size and weight of the core structure and accordingly in those of the transformer as a whole and provides difficulties in securely mounting the transformer on a printed circuit board at a low cost and by simple steps.

The core structure of a flyback transformer is usually formed with air gaps to prevent magnetic saturation of the core structure due to the flow of a current in the primary winding. Leakage flux is produced from these air gaps of the core structure and from exposed areas, if any, of the primary and secondary windings and tends to cause inductive interference with other electric circuits and circuit elements located in the neighbourhood of the transformer. To protect the circuits and circuit elements from such a disturbance, it is important that the circuits and circuit elements be located at sufficient spacings from the transformer. If this is to be performed in a printed circuit board, an extra space is required of the printed circuit board and makes it necessary to use a large-sized circuit board. If, furthermore, the flyback transformer is located in proximity to the cathode-ray tube, then the leakage flux of the transformer causes the electron beams to deviate from the paths determined by the deflection coils and spoils the purity of the image reproduced on the faceplate especially in a colour television receiver. The flyback transformer should therefore be located at a sufficient spacing from the cathode-ray tube. If it is undesired or impossible to obtain such a spacing in a television receiver set by reason of the specific configuration of the printed circuit board to be in use or the desired configuration of the cabinet, a shield element must be provided between the flyback transformer and the cathode-ray tube so as to magnetically isolate the cathode-ray tube from the leakage flux of the transformer. To prevent production of a corona discharge between the shield element and the secondary winding used as a high-voltage circuit, the secondary winding of the flyback transformer should be sufficiently spaced apart from the shield element, requiring the use of a large-sized receiver cabinet to provide such an extra space. The video image to be produced on the faceplate will also be degraded by the charges which are stored on the core structure and discharged onto the circuit elements on the printed circuit board and onto some metal elements forming part of the flyback transformer such as bolts and nuts securing the terminal plate to the core structure.

The flyback impulses induced in the windings of a flyback transformer produce mechanical vibrations in the core structure on which the secondary winding is carried. The vibrations are transferred to the printed circuit board supporting the transformer and through the circuit board to the various circuit elements on the board and produce unpleasant noises between each of the circuit elements and the printed circuit board and between the circuit board and the chassis on which the circuit board is mounted.

In addition to these drawbacks, problems have been encountered during assemblage of prior art flyback transformers, especially in impregnating the primary and secondary windings with a dielectric material in a mould, fastening the terminal plate and other complementary component parts to the core structure by bolts and nuts, and adjusting the sizes of the air gaps to be formed in the core structure.

SUMMARY OF THE INVENTION

The present invention contemplates elimination of all the above described drawbacks that have been inherent in prior art transformers particularly fly back transformers and, accordingly, the final object of the invention is to provide a transformer assembly which has a small-sized, light-weight and compact construction adapted for being mounted on a printed circuit board and which will provide safety and reliability of operation when in use.

In accordance with one important aspect of the present invention to achieve such a final object, there is provided a transformer assembly which comprises a ferromagnetic core structure having an open space therein, primary and secondary coil units mounted on the core structure and each including at least one winding arranged in insulated layers with taps brought out of the winding by lead wires, and a unitary void-free insulating envelope of heat-resistant, elastic dielectric material encapsulating the windings of the primary and secondary coil units and impregnating the interstices between the turns and layers of the windings, the insulating envelope including a portion occupying that area of the above mentioned open space which is situated between the winding of the secondary coil unit and an opposite portion of the subassembly of the core structure and the coil units. The core structure may be of an open type consisting of a single core section or of a split type consisting of two core sections held together to form the above mentioned open space, or window, therebetween. If the core structure is of the split type thus arranged, the primary and secondary coil units may be mounted either in concentric relationship or separately in parallel with each other on the core structure. If the primary and secondary coil units are arranged in concentric relationship to each other on the core structure, then the above mentioned portion of the insulating envelope may intervene between the winding of the secondary coil unit and that portion of the core structure which is located opposite to the winding of the secondary coil unit so as to preclude production of a corona discharge between the secondary coil unit and the particular portion of the core structure. In this instance, the insulating envelope may further include portions occupying remaining areas of the above mentioned open space in the core structure so that the open space is totally filled up, a portion covering directly or through a protective layer at least a portion of the outer faces of the core structure, a portion enclosing the entire structure of a bobbin forming part of the primary coil unit and carrying thereon the winding of the primary coil unit, and/or a projecting portion enclosing therein a lead-out portion of at least one of the lead wires. If, on the other hand, the primary and secondary coil units are mounted separately in parallel with each other on the core structure, then the first named portion of the insulating envelope may intervene between the respective windings of the primary and secondary coil units so as to preclude the production of a corona discharge between the windings. In this instance, the insulating envelope may further include portions occupying remaining areas of the open space in the core structure.

In accordance with another important aspect of the present invention, there is provided a method of manufacturing a transformer assembly, comprising producing primary and secondary coil units each including at least one winding arranged in insulated layers and at least one piece of core section to form a ferromagnetic core structure having an open space therein, mounting the primary and secondary coil units on the core structure, fitting the resultant subassembly of the core structure and coil units onto a hollow mould so that the windings of the primary and secondary coil units and that area of the above mentioned open space in the core structure which is situated between the winding of the secondary coil unit and an opposite portion of the aforesaid subassembly are enclosed within the cavity in the mould, heating the mould to a predetermined temperature, vacuumizing the cavity in the mould to establish a partial vacuum therein, injecting a heat-resistant dielectric material of fluid state into the cavity until the cavity is filled up in the presence of the partial vacuum, maintaining the mould at a predetermined temperature for a predetermined period of time for forming an elastic unitary insulating envelope including a portion encapsulating the windings of the primary and secondary coil units and impregnating the interstices between the turns and layers of the windings and a portion occupying the above mentioned area of the open space in the core structure, and withdrawing the resultant assembly from the mould.

BRIEF DESCRIPTION OF THE DRAWINGS

The features and advantages of the transformer assembly according to the present invention over prior art transformers and the details of the method according to the invention will become more apparent from the following description taken in conjunction with the accompanying drawings in which like reference numerals and characters designate corresponding parts, elements, units and structures and in which:

FIGS. 1 to 3 illustrate a first representative example of a prior art flyback transformer for use in a horizontal deflection circuit of a television receiver, wherein FIG. 1 is a front plan view of the flyback transformer, FIG. 2 is a side elevation view of the transformer and FIG. 3 is a fragmentary view showing the cross section of the subassembly of primary and secondary coil units of the flyback transformer;

FIGS. 4 to 6 are similar to FIGS. 1 to 3, respectively, but show another representative example of a prior art flyback transformer for use in a horizontal deflection circuit of a television receiver;

FIGS. 10 to 15 show a third preferred embodiment of a transformer assembly provided by the present invention, wherein FIGS. 10 to 12 are perspective views respectively showing the core structure, the primary coil unit in the process of assemblage and the secondary coil unit to construct the third embodiment, FIG. 13 is a perspective view showing the subassembly of the core structure and the primary and secondary coil units illustrated in FIGS. 10 and 12, FIG. 14 is a perspective view showing the transformer assembly produced from the subassembly of FIG. 13, and FIG. 15 is a cross sectional view taken along lines I—I of FIG. 14; and FIGS. 16 to 26 illustrate a fourth preferred embodiment of a transformer assembly provided by the present invention, wherein FIGS. 16, 18 and 19 are perspective views showing, respectively, the core structure, the primary coil unit in the process of assemblage and the secondary coil unit to construct the fourth embodiment, FIG. 17 is a perspective view which shows a bobbin forming part of the primary coil unit illustrated in FIG. 18, FIG. 20 is a side elevation view of the subassembly of the primary and secondary coil units which are held together, FIG. 21 is a perspective view showing the subassembly of the coil units and the sections of the core structure in the process of assemblage, FIG. 22 is a perspective view showing the subassembly of the core structure and the coil units in the process of assemblage, FIG. 23 is a view similar to FIG. 22 but shows the subassembly of the core structure and coil units in a complete form, FIG. 24 is a perspective view showing the transformer assembly produced from the subassembly illustrated in FIG. 23, FIG. 25 is a cross sectional view taken along lines II—II of FIG. 24, and FIG. 26 is a cross sectional view which is taken on lines III—III of FIG. 24.

DESCRIPTION OF THE PREFERRED EMBODIMENTS

Figure 5:
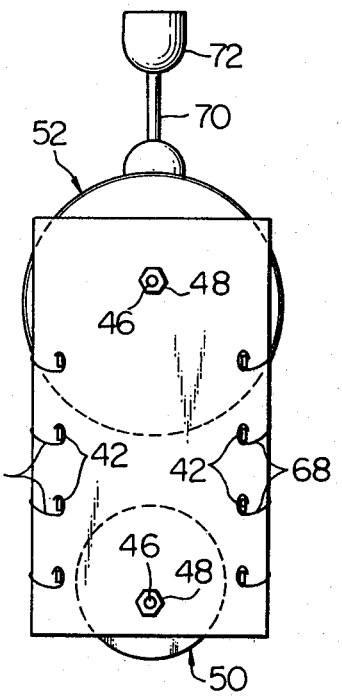
Fig. 5 PRIOR ART

Reference will now be made to the drawings, first to FIGS. 1 to 3 which illustrate an example of a prior art core-type flyback transformer for use in a horizontal deflection circuit for the cathode-ray tube of a television receiver. The flyback transformer comprises a ferromagnetic core structure 30 which is made up of a pair of generally U-shaped core sections forming a rectangular opening or "window" 32 therebetween. Each of the core sections consists of a pair of parallel arm portions 30*a* and 30*b* and an intermediate side portion 30*c* joining the arm portions 30*a* and 30*b*. As is well known in the art, each core section is constructed of a stack of ferromagnetic plates or laminations which are bonded to one another by a metal-to-metal adhesive. The two core sections are arranged in such a manner that the respective end faces of the arm portions 30*a* and 30*b* of one core section are slightly spaced apart from those of the arm portions 30*a* and 30*b*, respectively, of the other core section by means of non-magnetic spacer elements 34*a* and 34*b*, respectively, so as to form an air gap 36*a* between the end portions 30*a* and an air gap 36*b* between the arm portions 30*b*, as is seen in FIG. 3. A terminal plate 38 is attached to the outer side face of the intermediate side portion of one core section through a cushioning member 40. The terminal plate 38 is formed of a dielectric material and has fixedly mounted on its outer face a suitable number of terminal elements 42. To the outer side face of the intermediate side portion 30*c* of the other core section is attached a metal plate 44 through a cushioning member 40'. The terminal plate 38 and the metal plate 44 are fixed through the cushioning members 40 and 40', respectively, to the core sections by means of bolts 46 and nuts 48 so that the core sections are firmly braced to each other through the spacer elements 34*a* and 34*b* in the air gaps 36*a* and 36*b*.

The flyback transformer shown in FIGS. 1 to 3 further comprises a primary coil unit 50 and a secondary coil unit 52 which is assumed to constitute the high-voltage circuit of the transformer. As is seen in FIG. 3, the primary coil unit 50 comprises a winding 54 of a varnish-coated conductor which is helically wound in layers on a tubular bobbin 56 with insulating films 58 interposed between the individual adjacent layers of the winding 54. The secondary coil unit 52 is constructed essentially similarly to the primary coil unit 50 and, thus, comprises a winding 60 of a varnish-coated conductor helically wound in layers on a cylindrical bobbin 62 with insulating films 64 interposed between the individual adjacent layers of the winding 60. The secondary coil unit 52 is mounted in concentric relationship on the primary coil unit 50 which is inserted through the bore in the cylindrical bobbin 62. The resultant subassembly of the primary and secondary coil units 50 and 52 is encapsulated in a porosity free insulating envelope 66 of a dielectric resin such as for example silicon elastomer filling the interstices between the turns of the conductor and between the layers of the conductor and insulating films and forming an annular anti-corona layer 66*a* surrounding the secondary coil unit 52. The subassembly of the primary and secondary coil units 50 and 52 thus embedded in the insulating envelope 66 of the dielectric material is mounted on the core structure 30 with the arm portions 30*b* of the core sections closely inserted into the bore in the tubular bobbin 56 of the primary winding unit 50.

Taps are appropriately brought out of the windings 54 and 60 of the primary and secondary coil units 50 and 52 and are connected by lead wires 68 to the terminal elements 42 on the terminal plate 38 for electrical connection to various circuit elements forming part of or connected to the horizontal deflection circuit. Out of the winding 60 of the secondary coil unit 52 is further brought a high-voltage lead 70 for connection to a high-voltage rectifier (not shown) through a connecting cap 72.

Figure 6:
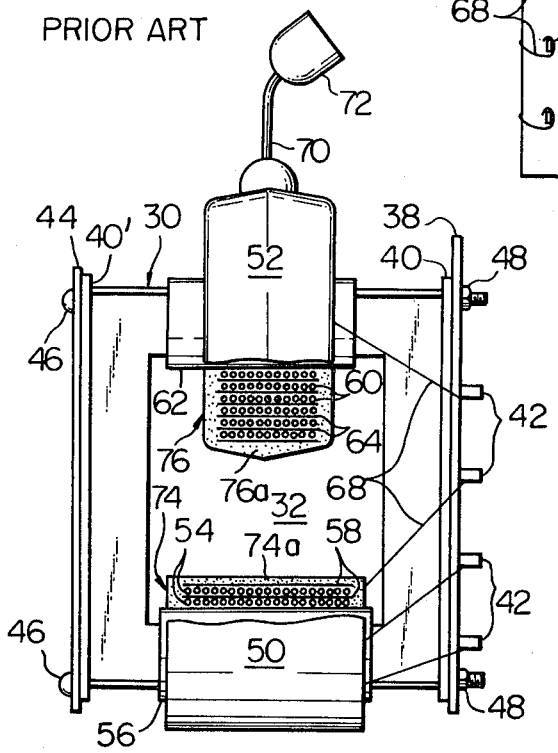
Fig. 6 PRIOR ART

FIGS. 4 to 6 show another example of a prior art flyback transformer for use in the horizontal deflection circuit of a television receiver. While the primary and secondary coil units 50 and 52 are arranged in concentric relationship and enclosed in a single insulating envelope of a dielectric resin in the transformer illustrated in FIGS. 1 to 3, the transformer shown in FIGS. 4 to 6 is arranged so that the primary and secondary coil units 50 and 52 are separately embedded in insulating envelopes 74 and 76, respectively, of a dielectric resin and are mounted on the arm portions 30*a* and 30*b*, respectively, of the core sections with the bobbins 56 and 62 closely received on the arm portions 30*a* and 30*b*, respectively. The insulating envelopes 74 and 76 enclosing the primary and secondary coil units 50 and 52 form, each in part, annular anti-corona layers 74*a* and 76*a* surrounding the coil units 50 and 52, respectively. The flyback transformer shown in FIGS. 4 to 6 is arranged similarly in other respects to the transformer illustrated in FIGS. 1 to 3.

Figure 7:
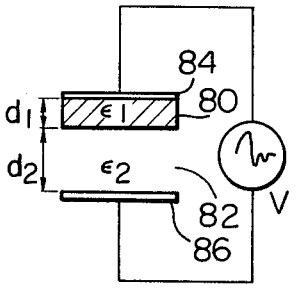
FIG. 7 is a schematic view showing an equivalent circuit of a dielectric system formed in the prior art flyback transformer illustrated in FIGS. 1 to 3.

In the prior art flyback transformer of the type shown in FIGS. 1 to 3, a layer of air is formed between a portion of the anti-corona layer 66*a* of the insulating envelope 66 and the arm portions 30*a* of the core sections. The layer of air constitutes in combination with the anti-corona layer 66*a* a composite dielectric system which can be represented by an equivalent circuit illustrated in FIG. 7. The dielectric system comprises a solid dielectric 80 constituted by the above mentioned portion of the anti-corona layer 66*a* and a gaseous dielectric 82 constituted by the above mentioned layer of air which inherently is a dielectric substance. The solid and gaseous dielectrics 80 and 82 are interposed between electrodes 84 and 86 which are respectively constituted, in effect, by the winding 60 of the secondary coil unit 52 and the set of aligned arm portions 30*a* of the core structure 30. Assuming, now, that the thickness and the dielectric constant of the solid dielectric 80 are $d_1$ and $\epsilon_1$, respectively, and the thickness and the dielectric constant of the gaseous dielectric 82 are $d_2$ and $\epsilon_2$, respectively, the electric field strengths $E_1$ and $E_2$ of the solid and gaseous dielectrics 80 and 82 are respectively given by $$E_1 = \epsilon_2 \cdot V/(\epsilon_1 d_2 + \epsilon_2 d_1)$$

and $$E_2 = \epsilon_1 \cdot V/(\epsilon_1 d_2 + \epsilon_2 d_1),$$

where $V$ is the flyback pulse voltage produced across the electrodes 84 and 86. Because, in this instance, the strength of the dielectric breakdown of air is less than the dielectric breakdown strength of a solid dielectric substance as is well known in the art and because the dielectric constant $\epsilon_2$ of the gaseous dielectric 82 is smaller than the dielectric constant $\epsilon_1$ of the solid dielectric 80, disruptive discharge takes place earlier through the gaseous dielectric 82 than through the solid dielectric 80 when the voltage V across the electrodes 84 and 86 is increased. Furthermore, the strength of the electric field impressed on the gaseous dielectric 82 in the presence of the solid dielectric 80 is greater than the field strength that would be impressed on the gaseous dielectric 82 in the absence of the solid dielectric 80. For this reason, the dielectric withstand voltage of the composite dielectric system as a whole is lower than the withstand voltage of a dielectric system consisting of a single dielectric substance. Thus, a corona discharge tends to take place through the layer 78 of air in the transformer illustrated in FIGS. 1 to 3.

In the case of the transformer of the type shown in FIGS. 4 to 6, a composite dielectric system is formed between the primary and secondary coil units 50 and 52 by two spaced solid dielectrics forming the anti-corona layers 74*a* and 76*a* on the coil units 50 and 52 and a gaseous dielectric constituted by the layer of air between the anti-corona layers 74*a* and 76*a*. The discussion given in connection with the equivalent circuit illustrated in FIG. 7 therefore applies in essence to the composite dielectric system thus produced in the transformer arrangement of FIGS. 4 to 6. Thus, a corona discharge tends to be produced through the layer of air between the anti-corona layers 74*a* and 76*a* formed by the insulating envelopes 74 and 76 on the primary and secondary coil units 50 and 52, respectively, of the transformer shown in FIGS. 4 to 6.

When a corona discharge is thus brought about through the layer of air, the dielectric material forming the insulating envelope 66 of the transformer shown in FIGS. 1 to 3 or each of the insulating envelopes 74 and 76 of the transformer shown in FIGS. 4 to 6 is caused to partially decompose or evaporate by the impacts of the electrons and ions in the corona discharge or by the heat of the corona or is chemically attacked by nitric acid and ozone produced in the air which is broken down. Thus, the corona discharge results in deterioration of the dielectric breakdown strength of the insulating envelope 66 in the transformer of FIGS. 1 to 3 or the insulating envelopes 74 and 76, especially the envelope 76 on the secondary or high-voltage coil unit 52 of the transformer of FIGS. 4 to 6 and eventually destroys the insulation between the secondary coil unit and the core structure in the former transformer arrangement or between the primary and secondary coil units in the latter transformer arrangement. This will not only cause a failure in the transformer and accordingly in the television receiver but may in the worst case lead to firing or emission of smoke from the secondary coil unit of the transformer which is subjected to high voltage.

To avoid such dangers, it is required to have the core structure sized and shaped to provide an ample space between the secondary coil unit 52 and the arm portions 30*a* of the core sections in the transformer of FIGS. 1 to 3 or between the primary and secondary coil units 50 and 52 in the transformer of FIGS. 4 to 6 so as to preclude production of a corona discharge through such a space. In a usual colour television receiver using a flyback transformer having voltage ratings to develope a peak plate voltage of the order of 20 to 30 kilovolts by the aid of a voltage multiplier such as a voltage doubler or trippler circuit, the flyback transformer is required to produce an output voltage of the order of 10 to 15 kilovolts in the secondary coil unit 52 used as the high-voltage output circuit, as is well known in the art. If, in this instance, the insulating envelope to enclose the secondary coil unit is formed of silicon elastomer which has a dielectric constant of approximately 3.3, it is necessary that the insulating envelope be formed to have the thickness of 2.5 to 4 millimeters or more at least in its portion opposite to the arm portions 30*a* of the core structure in the transformer of FIGS. 1 to 3 or to the primary coil unit 50 in the transformer of FIGS. 4 to 6. This means that, in the case of the transformer arrangement illustrated in FIGS. 1 to 3, the core structure 30 must be sized and shaped to provide the spacing of about 10 to 16 millimeters between the outer face of the insulating envelope 66 and the arm portions 30*a* of the core structure 30. If the spacing between the insulating envelope 66 and the arm portions 30*a* is less than range, corona discharge will tend to occur through the spacing the more frequently so that the insulating envelope 66 will be deteriorated the more rapidly and cause the breakdown the earlier. The spacing between the winding 60 of the secondary coil unit 52 and the arm portions 30*a* of the core structure 30 of the flyback transformer of the type shown in FIGS. 1 to 3 should, thus, be about 13 to 20 millimeters to enable the transformer to operate properly for a prolonged period of time.

To provide such a spacing in the transformer assembly, the core structure 30 must be sized and shaped to form a sufficiently elongated window therein. This gives rise to reduction of the ratio of the cross sectional area of the core structure to the length of the magnetic path with a consequent decrease in the ratio of the inductance of the winding 54 of the primary coil unit 50 to the inductance of the horizontal deflection coil of the cathode-ray tube. This causes the deflection current to be shunted by the primary winding of the transformer and reduces the deflection efficiency provided by the flyback transformer. If, furthermore, the inductance of the primary winding of the transformer becomes less than three times the inductance of the horizontal deflection coil, then the fluctuations in the tuning performance of the secondary winding are extremely intensified due to the fluctuations in the inductance of the primary winding and enhance the fluctuations in the power output and the voltage regulation percentage of the transformer. If the number of turns of the primary winding is increased to avoid this, then it becomes necessary to also increase the number of turns of the secondary winding. This results in an increase in the overall diameter of the secondary coil unit 52 mounted on the primary coil unit 50 and consequently reduces the spacing between the secondary coil unit 52 and the arm portions 30*a* of the core structure 30 in the transformer shown in FIGS. 1 to 3. For this reason, the inductance of the primary winding must be increased by making the cross sectional area of the core structure 30 the larger as the magnetic path of the core structure is made the longer. This results in increases in the size and weight of the core structure and accordingly in those of the transformer as a whole and is, therefore, objectionable for the purpose of mounting the transformer on a printed circuit board.

Figure 8:
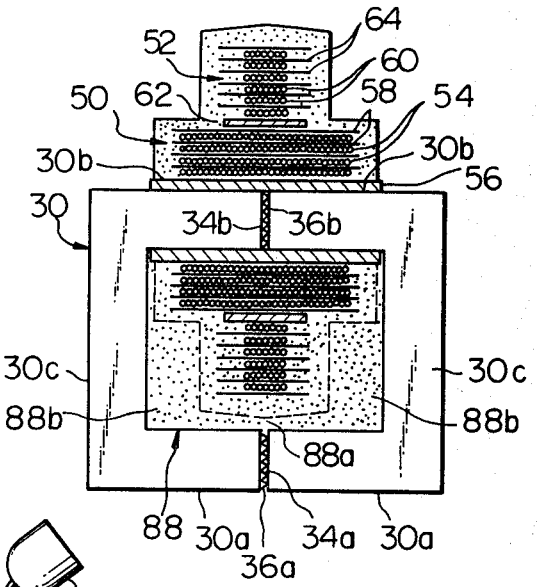
FIG. 8 is a fragmentary view showing, partly in section, a first preferred embodiment of a transformer assembly according to the present invention.
Figure 9:
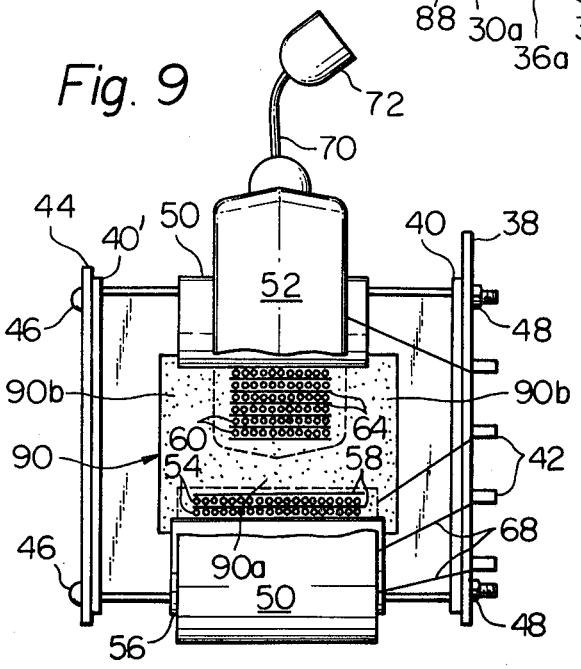
FIG. 9 is a front plan view showing, partly in section partially cut away, a second preferred embodiment of a transformer assembly according to the present invention.

A prime object of the present invention is to provide a transformer assembly free from all these drawbacks that have been inherent in prior art flyback transformers of the type illustrated in FIGS. 1 to 3 or of the type illustrated in FIGS. 4 to 6. FIGS. 8 and 9 show preferred embodiments of the present invention to achieve this object. Another object of the present invention is to provide a method of manufacturing such a transformer assembly by simple steps and at a low cost.

The embodiment illustrated in FIG. 8 corresponds in construction to a prior art flyback transformer of the type shown in FIGS. 1 to 3 and, thus, includes primary and secondary coil units 50 and 52 which are mounted in concentric relationship on the arm portions **30*b* of the core structure 30. Though not shown in FIG. 8, the core structure 30 is braced between the terminal plate 38 and metal plate 44 through the cushioning members 40 and 40' by means of the bolts 46 and nuts 48 as shown in FIGS. 1 and 2**.

While the prior art flyback transformer shown in FIGS. 1 to 3 is provided with the insulating envelope 66 formed on the primary and secondary coil units 50 and 52 in such a manner as to leave an open space in the window 32 in the core structure 30, the transformer assembly illustrated in FIG. 8 has an insulating envelope 88 which not only encapsulates the subassembly of the primary and secondary coil units 50 and 52 as indicated in part by a broken line but fills the total area between the core structure 30 and the primary and secondary coil units 50 and 52. Thus, the insulating envelope 88 consists of, in addition to the portion surrounding the subassembly of the primary and secondary coil units 50 and 52, a portion **88*a* occupying the total area between the secondary coil unit 52 and the arm portions 30*a* of the core structure 30 and portions 88*b* each occupying the total area between the inner face of each of the intermediate side portions 30*c* of the core structure 30 and the side ends of the primary and secondary coil units 50 and 52. If desired, the portions 88*b* may be removed from the insulating envelope 88 if the secondary coil unit 52 is spaced apart a sufficient distance from each side portion 30*c* of the core structure 30** so that there will be no danger that a corona discharge is brought therebetween.

In the presence of the dielectric layer **88*a* thus filling the total area between the secondary coil unit 52 and the arm portions 30*a* of the core structure 30 or, in other words, in the absence of a layer of air therebetween, the dielectric strength between the secondary coil unit 52 and the arm portions 30*a* is determined solely by the dielectric breakdown strength of the material forming the insulating envelope 88** and is not affected by the layer of air.

With the insulating envelope 88 thus formed in the window in the core structure 30, the dielectric breakdown strength between the secondary coil unit 52 and the core structure 30 is made far greater than that of the composite dielectric system intervening therebetween in the prior art transformer of FIGS. 1 to 3 and, for this reason, the distance between the secondary coil unit 52 and the arm portions **30*a* of the core structure 30 can be significantly reduced as compared with the prior art transformer. If, thus, the transformer assembly shown in FIG. 8 is designed to produce an output voltage of the order of 10 to 15 kilovolts, the spacing between the secondary coil unit 52 and the arm portions 30*a* of the core structure 30 may be of the order of only 4 millimeters and can be reduced approximately 12 millimeters from about 16 millimeters in the case of the prior art transformer arrangement shown in FIGS. 1 to 3. The length of the magnetic path of the core structure 30 can therefore be reduced about 24 millimeters from that of the prior art transformer so that the core structure 30** can be designed to have a sufficiently large ratio of the cross sectional area to the length of the magnetic path thereof. This is reflected by an increase in the inductance of the primary winding and accordingly by an increase in the ratio of the inductance of the primary winding to the inductance of the horizontal deflection coil of a cathode-ray tube if the transformer assembly is used in a television receiver. The transformer assembly embodying the present invention is, thus, not only adapted to be mounted on a printed circuit board because of its small-sized and light-weight construction but is useful for improving the performance efficiency of the horizontal deflection circuit of a television receiver.

Because, furthermore, the layer of air formed in the window of the core structure of a prior art flyback transformer is replaced with the layer of a dielectric resin which is a better heat conductive medium than air, heat generated in the core structure and coil units during operation of the transformer assembly can be liberated therefrom at a higher efficiency than in the prior art transformer so that the deterioration of the insulating envelope and the various kinds of loses as caused by the heat can be minimized. This will significantly raise the performance efficiency of the transformer assembly and contribute to prolonging the service life of the transformer assembly. It may be noted in this regard that the service lives of insulating materials in general are doubled when the temperatures to which the materials are subjected are reduced by 8° to 10° C.

The transformer assembly thus far described with reference to FIG. 8 can be manufactured in any of the following two manners from the sections to form the core structure 30 and the primary and secondary coil units 50 and 52 which have been preliminarily produced separately of each other. In one method, the primary and secondary coil units 50 and 52 are secured in concentric relationship to each other by means of an adhesive applied therebetween. The resultant subassembly of the primary and secondary coil units 50 and 52 is mounted on the core structure 30 by fitting the arm portions **30*b* of the core sections into the bore in the bobbin 56 of the primary coil unit 50 in opposite directions with the spacer elements 36*a* and 36*b* interposed between the arm portions 30*a* and 30*b*, respectively. The subassembly of the primary and secondary coil units 50 and 52 thus installed on the core structure 30 is then placed within the cavity of a sealed mould (not shown) which is internally so configured as to accommodate therein the entire structure of the subassembly of the coil units 50 and 52 and the entire open space in the window of the core structure 30. The mould is heated to a predetermined temperature and is internally vacuumized to establish a partial vacuum therein. An elastic heat-resistant dielectric material, such as for example, silicon rubber, of fluid state is then injected under pressure into the mould until the cavity in the mould is filled with the dielectric material. The mould is kept heated for a predetermined period of time and, when the dielectric material therein is set or cured, the assembly formed with the insulating envelope 88 of the dielectric material is removed from the mould. While the insulating envelope 88 is produced by a single process in the method above described, such an envelope is formed by two processes with use of two different moulds (not shown) in the other method of manufacturing the transformer assembly shown in FIG. 8. A first mould has a cavity which is conconfigured in such a manner as to form a basic layer of a dielectric material around the subassembly of the primary and secondary coil units 50 and 52 as indicated in part by the broken line in FIG. 8. A second mould is formed with a cavity which is configured to form on the basic layer an additional layer of dielectric material to fill the total open area in the window of the core structure 30, viz., between a portion of the external surface of the basic layer and the inner faces of the core structure 30 defining the window therein. To form the insulating envelope 88 with use of these two moulds, the subassembly of the primary and secondary coil units 50 and 52 is first placed within the first mould before the subassembly is mounted on the core structure 30. The mould is internally heated and vacuumized to establish a partial vacuum therein and a dielectric material of fluid state is injected into the cavity in the mould until the cavity is completely filled up with the material. When the dielectric material in the mould is cured, the subassembly of the coil units 50 and 52 is formed with the basic layer of the dielectric material. The subassembly of the coil units 50 and 52 thus encased in the basic layer is withdrawn from the first mould and is mounted in concentric relationship on the core structure 30 in a manner previously described. The core structure 30 thus carrying the subassembly of the coil units 50 and 52 wrapped in the basic layer of the dielectric material is then fitted to the second mould in such a manner that the total open space between the basic layer and the core structure 30 is enclosed within the mould. The second mould is heated and vacuumized to establish a vacuum therein and a dielectric material of fluid state is injected into the mould unitl the cavity in the mould is completely filled up. When the dielectric material thus injected into the second mould is cured, the transformer assembly is formed with the insulating envelope 88 which in part encloses the subassembly of the coil units 50 and 52 by its basic layer portion and in part fills the entire open space between the basic layer and the core structure 30** by its additional layer portion. The dielectric material forming the additional layer portion is preferably of the same type as the dielectric material forming the basic layer portion but, if desired, may be of a different type if the two materials have substantially equal dielectric constants.

The insulating envelope 88 thus formed not only encapsulates the subassembly of the primary and secondary coil units 50 and 52 and fills the total open area of the window in the core structure 30 but impregnates the individual interstices between the turns of the windings 54 and 60 of the coil units 50 and 52 and between the layers of the windings 54 and 60 and insulating films 58 and 64 of the coil units in a porosity-free fashion.

FIG. 9 illustrates an embodiment of the present invention applied to the transformer of the type shown in FIGS. 4 to 6. The embodiment of FIG. 9 thus comprises primary and secondary coil units 50 and 52 mounted separately of each other on the arm portions 30*a* and 30*b*, respectively, of the core structure 30 and is arranged similary to the prior art transformer of FIGS. 4 to 9 except for the insulating envelope formed thereon. While the insulating envelopes 74 and 76 of the prior art transformer arrangement shown in FIGS. 4 to 6 are provided separately of each other on the primary and secondary coil units 50 and 52, respectively, and thus form an open space in the window 32 of the core structure 30, the transformer assembly illustrated in FIG. 9 has a unitary insulating envelope 90 which not only encloses therein the primary and secondary coil units 50 and 52 as indicated in part by broken lines but fills up the window in the core structure 30. Thus, the insulating envelope 90 of the enbodiment illustrated in FIG. 9 consists of, in addition to the portions respectively surrounding the primary and secondary coil units 50 and 52, a portion 90*a* occupying the total area between the primary and secondary coil units 50 and 52 and portions 90*b* filling the areas of the window along the inner faces of the intermediate side portions 30*c* of the core structure 30. If desired, the portions 90*b* may be removed from the insulating envelope 90 if the secondary coil unit 52 is spaced apart a sufficient distance from each of the side portions 30*c* of the core structure 30 so that there will be no danger of a corona discharge being produced therethrough.

As in the case of the embodiment illustrated in FIG. 8, the insulating envelope 90 thus arranged can be formed in two different methods. In one method, the primary and secondary coil units 50 and 52 void of insulating layers are first mounted on the core structure 30 and thereafter the resultant subassembly of the core structure 30 and the coil units 50 and 52 are fitted to a mould (not shown) which is formed with a cavity configured in such a manner as to accommodate therewithin the entire construction of the primary and secondary coil units 50 and 52 and the entire open area of the window in the core structure 30 carrying the coil units. The mould thus arranged with the subassembly of the core structure 30 and the coil units 50 and 52 is heated to a predetermined temperature and is internally vacuumized to establish a partial vacuum in the cavity. A heat-resistant dielectric material such as silicon rubber of fluid state is then injected under pressure into the cavity in the mould until the cavity is completely filled up with the material. The mould is kept heated for a predetermined period of time and, when the material in the mould is cured, the assembly now including the insulating envelope 90 is withdrawn from the mould. While only one mould is used in the method above described, a total of three moulds (not shown) are used in the other method of forming the insulating envelope 90. A first mould is formed with a cavity which is configured to form a basic layer of dielectric material encapsulating the primary coil unit 50 as indicated in part by the broken line surrounding the primary coil unit in FIG. 9. A second mould is essentially similar to the first mould but is adapted to form a basic layer on the secondary coil unit 52 as indicated in part by the broken line surrounding the secondary coil unit in FIG. 9. A third mould is formed with a cavity which is configured to form on the basic layers on the primary and secondary coil units an additional layer of dielectric material to totally fill the window in the core structure carrying the coil units. To produce the insulating envelope 90 with use of these three mould, the primary and secondary coil units 50 and 52 are first placed within the first and second moulds, respectively. The first and second moulds are internally heated and vacuumized to establish a partial vacuum in each of the moulds. A dielectric material of fluid state is then injected into each of the first and second moulds until each mould is completely filled up with the injected material. The moulds are kept heated for a predetermined period of time until the dielectric material in each of the moulds is cured and forms a basic layer of the material on each of the coil units. The coil units 50 and 52 are then withdrawn from the first and second moulds and are mounted on the core structure 30 in a manner previously described. The resultant subassembly of the core structure 30 and the coil units 50 and 52 encapsulated in the respective basic layers of the dielectric material is fitted to the third mould so that the window in the core structure 30 carrying the coil units 50 and 52 is totally enclosed within the third mould. The third mould is then internally heated and vacuumized and a dielectric material of fluid state is injected into the mould until the cavity in the mould is filled up. When the dielectric material in the mould is cured, the assembly now provided with the insulating envelope 90 is withdrawn from the third mould. The dielectric materials to be injected into the three moulds may be of the same type or, if desired, may be of different types if the different materials have substantially equal dielectric constants.

When in forming the insulating envelope 88 of the embodiment of FIG. 8 or the insulating envelope 90 of the embodiment of FIG. 9, precautions should be taken to prevent the lead wires 68 from being caught by any projecting parts of the mould or moulds as by detachably anchoring the lead wires to the bobbin 56 of the primary coil unit 50 in the embodiment of FIG. 8 or the bobbins 56 and 62 of the primary and secondary coil units 50 and 52 of the embodiment of FIG. 9. If such an expedient is not resorted to, the lead wires might be broken or disconnected from the coil units. When the formation of the insulting envelope 88 or 90 is complete, it is necessary to have the lead wires released from the bobbin or bobbins and cleaned of the dielectric material which has been deposited, if any, on the wires. A disproportionate amount of time and labour would thus be for the moulding operation to form the insulating envelope 88 or 90. The lead wires 68 are, furthermore, usually secured one after another to the terminal elements 42 by soldering and, for this reason, tend to be slackened and locally get closer to each other. If, therefore, a potential difference of a considerable degree is produced between the lead wires having portions located close to each other, a corona discharge tends to be caused therebetween and may destroy the insulation of the transformer assembly. Such an accident may also be invited if dust is deposited between the terminal element 42 or the lead wires 68 on the terminal plate 38 especially in the presence of moisture.

The transformer assembly is mounted on a printed circuit board (not shown) by the use of the bolts 46 and nuts 48 because the transformer assembly per se can not be securely supported on the printed circuit board simply by soldering the terminal elements 42 to the circuit board. A time-consuming procedure is thus needed to mount the transformer assembly on a printed circuit board. In the course of mounting the transformer assembly on a printed circuit board or mounting the printed circuit board carrying the transformer assembly in a television receiver or during inspection, transportation and handling of the transformer assembly, care should be exercised so as not to have the lead wires 68 hit and broken by a tool or any projecting or solid part. All these are reflected, in the result, by an increase in the production cost of the transformer assembly.

The air gaps **36*a* and 36*b* (FIG. 8) in the core structure 30 are provided for the purpose of avoiding the magnetic saturation of the core structure due to the flow of current through the primary coil unit. During operation of the transformer assembly, a considerable quantity of leakage flux is produced from these air gaps or, in a prior art transformer having primary and secondary windings having exposed portions, from such exposed portions. In installing the transformer in a television receiver or in any other electric system, serious design consideration must be paid so that those circuits and circuit elements which are susceptible to the leakage flux are located at sufficient spacings from the transformer. If, furthermore, the transformer is located in the vicinity of a cathode-ray tube as in a television receiver, especially, a colour television receiver, the electron beams produced in the cathode-ray tube are unduly deflected under the influence of the leakage flux from the transformer and critically impairs the quality of the image reproduced on the faceplate of the cathode-ray tube. To avoid this, the transformer should be sufficiently spaced apart from the cathode-ray tube so that the electron beams in the tube are not affected by the leakage flux from the transformer. To satisfy all these requirements for a transformer to be mounted on a printed circuit board, it is inevitable to use an extremely large-sized printed circuit board. If a space to accommodate such a large-sized printed circuit board is not available in a system into which the transformer is to be incorporated, a shield element must be provided between the transformer and any element or unit susceptible to the leakage flux. The shield element should be located at a sufficient spacing from the secondary coil unit of the transformer so as to prevent the production of a corona discharge between the shield element and the secondary coil unit. This, again, requires an ample space over the printed circuit board on which the transformer is to be mounted. During operation of the transformer, furthermore, the core structure 30 is caused to mechanically vibrate by the impulses produced in the primary and secondary windings 54 and 60. If the transformer is mounted on a printed circuit board, the vibrations are transferred through the bolts 46, nuts 48, terminal plate 38 and terminal elements 42** to the printed circuit board and, through the circuit board, to other circuit elements on the board and to the chasis supporting the board, producing unpleasant noises from the printed circuit board and chasis.

It is, therefore, still another object of the present invention to provide a transformer assembly which is simple and compact in construction, easy and economical to manufacture, adapted for installation on a printed circuit board, reliable in operation and compatible, in effect, with any electrical unit or element susceptible to leakage flux from an external source. A further object of the present invention is to provide a method of manufacturing such an improved transformer assembly in simple and economical steps.

Figure 10:
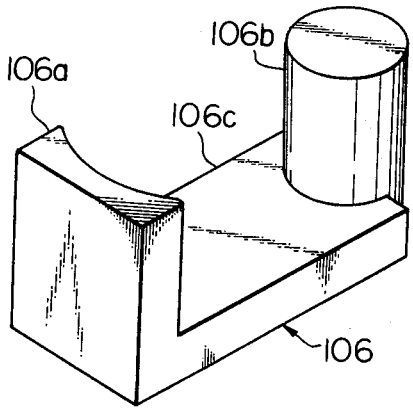
Figure 11:
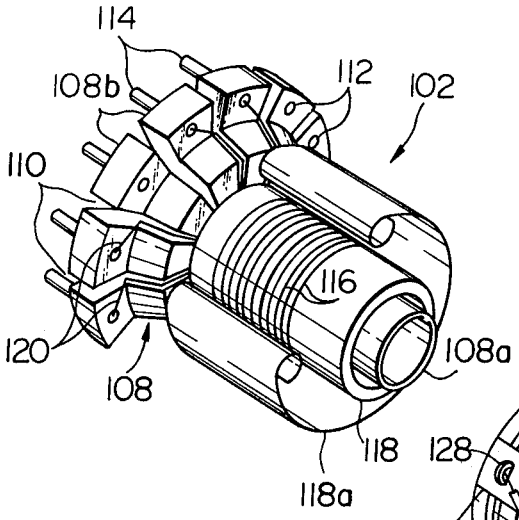
Figure 12:
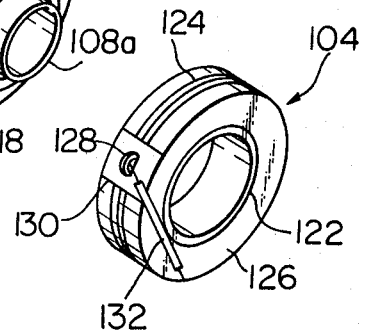

Referring concurrently to FIGS. 10 to 15, first particularly to FIGS. 10 to 12 of the drawings, an embodiment of a transformer assembly to achieve the above mentioned object largely comprises a core structure 100 (shown in half in FIG. 10), a primary coil unit 102 (FIG. 11) and a secondary coil unit 104 (FIG. 12).

The core structure 100 consists of a pair of core sections 106 each having two spaced parallel arm portions **106*a* and 106*b* of equal lengths and an intermediate portion 106*c* integrally joining the arm portions 106*a* and 106*b*, as best seen in FIG. 10. The arm portions 106*a* and 106*b* of each core section are spaced apart a predetermined distance from each other and are perpendicular to the intermediate portion 106c of the core section. For the reason that will be clarified as the description proceeds, one of the arm portions 106a and 106b, herein shown as the arm portion 106b, of each core section has a cylindrical configuration having a predetermined diameter. As will be also clarified later, the other arm portion 106a is shown to have a concave inner face having a curvature which is substantially concentric relationship to the cylindrical arm portion 106b**. Each core section is constructed of a stack of ferromagnetic plates which are securely bonded together into a unitary structure by means of a metal-to-metal adhesive as is customary in the art.

Turning to FIG. 11, the primary coil unit 102 comprises a bobbin 108 consisting of a tubular portion 108a which is open at both ends and a suitable number of radial portions 108b projecting radially outwardly from one axial end of the tubular portion 108a and circumferentially spaced apart from one another to form radial gaps 110 between the radial portions 108b. The tubular portion 108a has an inside diameter slightly larger than the diameter of the cylindrical arm portion 106b of each section of the core structure 100 and a length substantially equal to the sum of the lengths of the arm portions 106b projecting from the inner faces of the respective intermediate portions 106c of the core sections. The radial portions 108b as a whole form a generally sectoral flange having a suitable central angle forming a sectoral open space between the two arm portions located at the circumferential ends of the sectoral flange. The sectoral flange formed by the radial portions 108b is shown to have an obtuse central angle but may be arranged to have an acute angle forming a sectoral open space of an obtuse central angle between the two radial portions at the circumferential ends of the flange. Each of the radial portions 108b is formed with a through hole 112 extending in parallel to the axis of the bobbin 108 and open at the opposite ends thereof. A tubular terminal element 114 is closely received in each of the through holes 112 and projects axially outwardly from the axially outer end of the through hole. The bobbin 106 thus shaped is formed of a suitable premixed moulding compound such as for example unsaturated polyester resin added with a suitable reinforcing composition.

The primary coil unit 102 further comprises a winding 116 of a varnish-coated conductor helically wound in layers on the tubular portion 108a of the bobbin 108 with insulating films 118 interposed between the adjacent layers of the winding 116 to provide layer-to-layer insulation. The outermost layer of the winding 116 is wrapped in an insulating film 118a of preferably the same dielectric material as that of the layer-to-layer insulating films 118. The outermost insulating film 118a is secured to the winding 116 by means of a suitable adhesive tape (not shown) of a heat-resistant dielectric material such as polyester resin. Taps are brought out of the winding 116 and are connected to separate lead wires 120 for electrical connection to external circuits and circuit elements (not shown). The lead wires 120 extend on the outer faces of the radial portions 108b of the bobbin 108 and/or through the gaps 110 between the radial portions 108b and are respectively connected to the terminal elements 114 through the through holes 112 in the radial portions 108b. The lead wires 120 are passed through the bores in the tubular terminal elements 114 and are preferably soldered at their ends to the open leading ends of the terminal elements 114.

On the other hand, the second coil unit 104 comprises, as shown in FIG. 12, a hollow cylindrical bobbin 122 having open axial ends. The bobbin 122 has an inside diameter slightly larger than the outside diameter of the winding 116 of the primary coil unit 102 and an axial length smaller than that of the primary winding 116. The bobbin 122 is preferably formed of the same material as that of the bobbin 108 of the primary coil unit 102. A varnish-coated conductor is helically wound in layers on the bobbin 122 to form a secondary winding 124 with insulating films 126 interposed between the adjacent layers of the winding 124 to provide layer-to-layer insulation. The insulating film 126 used in the secondary coil unit 104 may be of the type which is processed to produce an outer surface of mat form. The terminal end of the conductor forming the secondary winding 124 is connected to a terminal element 128, which is held in position on the winding 124 by means of an adhesive tape 130 of a heat-resistant, dielectric material such as polyester resin. The terminal element 128 is connected to an insulated lead wire 132 for connection to an external circuit or circuit element such as a high-voltage rectifier of the horizontal deflection circuit (not shown) of a television receiver.

The respective numbers of the layers of the windings 116 and 124 of the primary and secondary coil units 102 and 104 and the numbers of the turns in the individual layers are selected depending upon the desired performance characteristics of the transformer assembly to be obtained.

The core structure 100 and the primary and secondary coil units 102 and 104 thus constructed and arranged are assembled together in the following manners.

Figure 13:
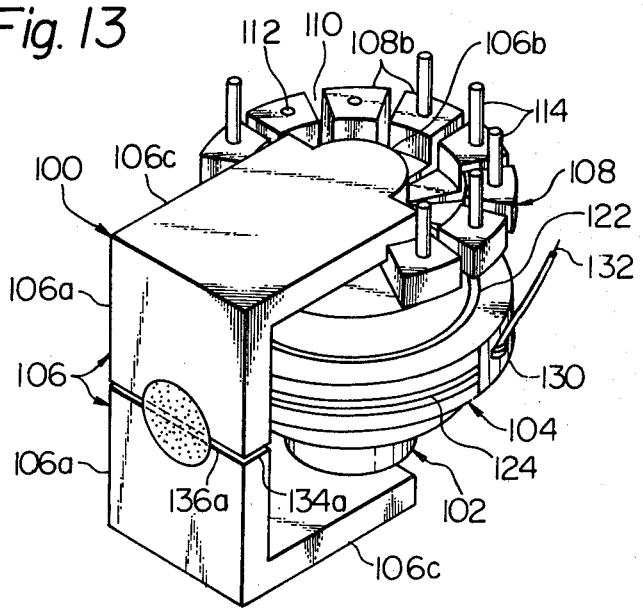

A suitable adhesive is applied to the outer peripheral surface of the outermost insulating film 118a of the primary coil unit 102 or the inner peripheral surface of the bobbin 122 of the secondary coil unit 104, or to both. The primary and secondary coil units 102 and 104 are then fitted in concentric relationship to each other in such a manner that the bobbin 122 of the latter is securely received on and bonded to the outer peripheral surface of an axially central portion of the outermost insulating film 118a of the former. The resultant subassembly of the primary and secondary coil units 102 and 104 is in part seen in FIG. 13. The subassembly of the coil units 102 and 104 is mounted on the core structure 100 by inserting the cylindrical arm portions 106b of the core sections into the bore in the tubular portion 108a of the bobbin 108 of the primary coil unit 102 with spacer elements 134a and 134b (FIG. 15) of a non-magnetic material interposed between the end faces of the arm portions 106a and 106b, respectively. The core sections are, thus, held in position relative to each other with their respective arm portions 106a and 106b slightly spaced apart from each other by the spacer elements 134a and 134b, respectively, and the intermediate portion 106c of one of the core sections extending through the previously mentioned sectoral open space between the circumferentially outermost two of the radial portions 108b of the bobbin 108 of the primary coil unit 102 as seen in FIG. 13. The core sections thus assembled together are secured to each other by a suitable metal-to-metal adhesive preliminarily applied in spot form to the end faces of the arm portions 106a and 106b of the core sections. The spots of the adhesive thus formed between the end faces of the arm portions 106a and 106b are seen at 136a and 136b, respectively, in FIG. 15.

Figure 14:
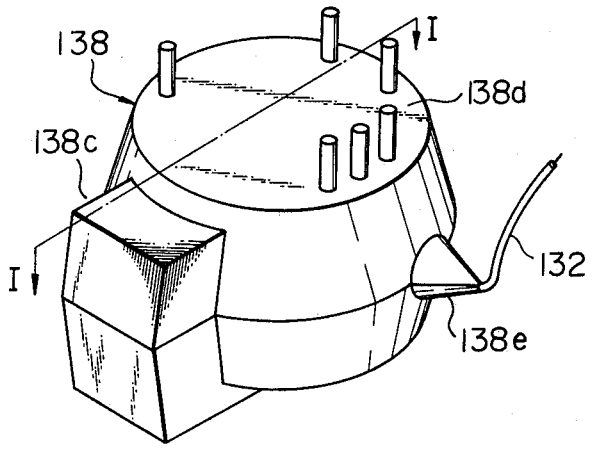
Figure 15:
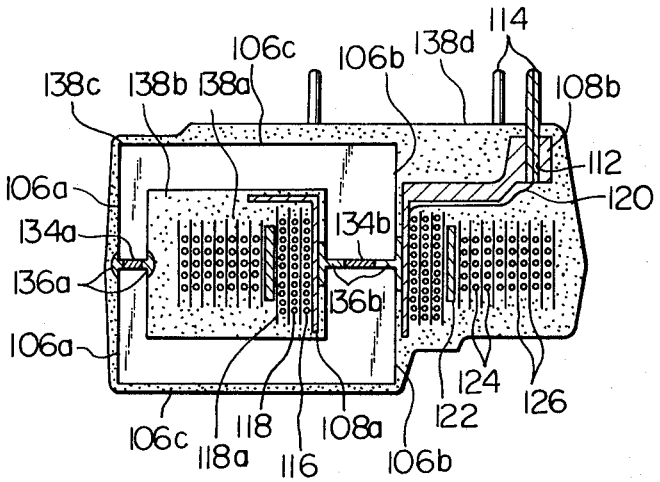

The subassembly of the core structure 100 and the primary and secondary coil units 102 and 104 is then processed in a mould (not shown) so as to form thereon an insulating envelope 138. The mould which is used for this purpose is formed with a cavity which is so configured that will accommodate the entire structure of the subassembly except for the leading end portions of the terminal elements 114. The subassembly of the core structure 100 and coil units 102 and 104 is placed in its entirety within the cavity of the mould with the leading end portions of the terminal elements 114 projecting out of the mould. The mould is then internally heated to a predetermined temperature and vacuumized to establish therein a partial vacuum lower than 10 millimeters of mercury. An elastic heat-resistant dielectric material of, for example, silicon rubber of fluid state is then injected under the pressure of about 10 to 20 kgs/cm$^2$ into the cavity of the mould until the cavity is completely filled up with the material in the presence of vacuum in the cavity. The mould is kept heated at a predetermined temperature of, for example, about 104° to 150° C for a predetermined period of time of, for example, 2 to 3 minutes. When the injected material in the mould is cured, there is obtained a transformer assembly having the insulating envelope 138 as illustrated in FIGS. 14 and 15. As is seen in FIG. 15, the insulating envelope 138 thus formed consists of a portion **138*a* surrounding the layers of the primary and secondary windings 116 and 124, a portion 138*b* filling up the space formed between the core structure 100 and the subassembly of the coil units, a thin layer portion 138*c* covering outer faces of the core structure 100, a layer portion 138*d* enclosing the radial portions 108*b* of the bobbin 108 of the primary coil unit 108 with the leading end portions of the terminal elements 114 projecting therefrom, and a projecting portion 138*e* (FIG. 14) wrapping the lead-out portion of the lead wire 132 from the terminal element 128 on the secondary coil unit 104. The projecting portion 138*e* is effective to provide reinforcement to the mechanical connection between the terminal element 128 and the lead 132 and assure the hermetic sealing between the lead wire 132 and the insulating envelope 138. The portion 138*a* surrounding the primary and secondary windings 116 and 124 not only encapsulates the layers therein but impregnates the individual interstices between the layers of the windings 116 and 124 and the insulating films 118 and 126 and between the turns of each of the layers of the windings in a void-free fashion due to the partial vacuum developed in the mould when the insulating envelope 138 is being formed therein. The layer portion 138*d* wrapping the radial portions 108*b* of the bobbin 108 of the primary coil unit 102 fills up the individual gaps 110 between the radial portions 108*b* and assuredly isolates the lead wires 120 stretched on the surfaces of the radial portions 108*b* and/or in the gaps 110. If desired, however, the insulating envelope 138 may be configured to be void of the particular portion 138*d* especially if the bobbin 108** is constructed of a sufficiently arc-resistant, fire-proof material.

The radial portions **108*b* of the bobbin 108 are shown in FIGS. 11 and 13 as having generally rectangular cross sections but, if desired, they may be shaped to have circular or oval cross sections formed with the through holes 112 adapted to receive the tubular terminal elements 114**.

Figure 17:
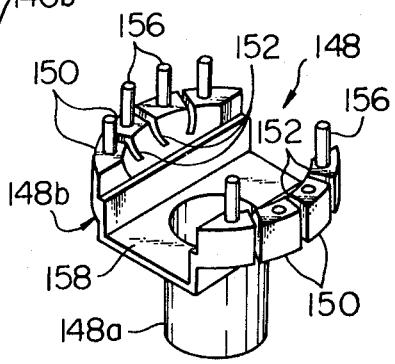
Figure 18:
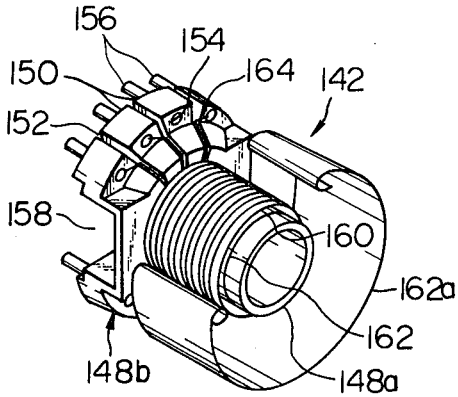
Figure 19:
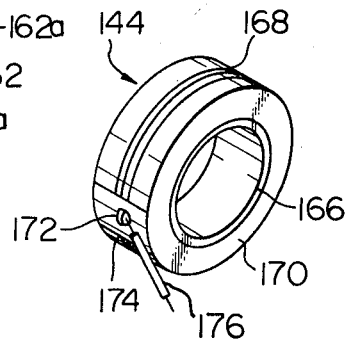
Figure 21:
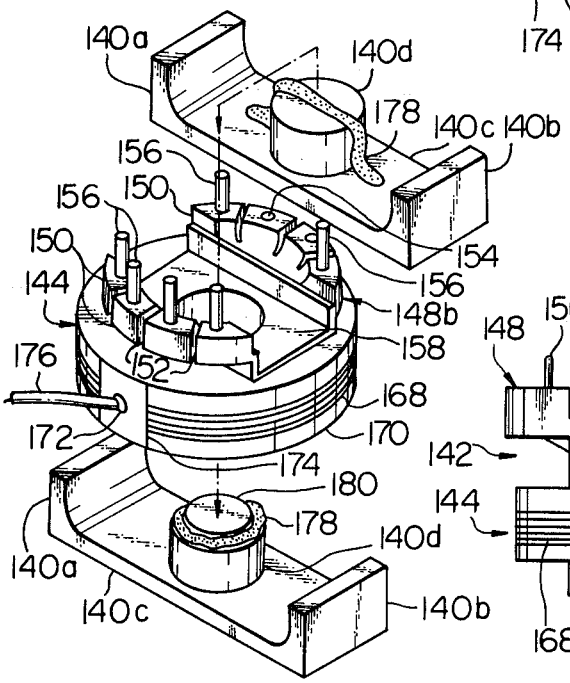
Figure 20:
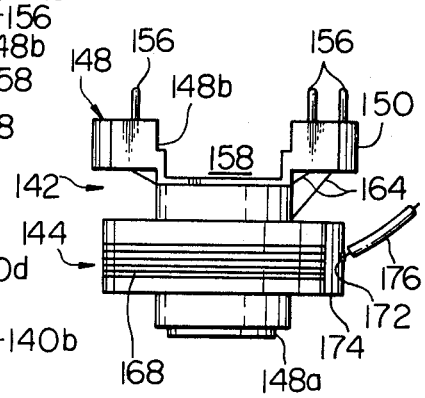

FIGS. 16 to 26 illustrated an alternative embodiment of the transformer assembly of FIGS. 10 to 15. Referring to FIGS. 16 to 26, first particularly to FIGS. 16 to 19, the transformer assembly comprises a core structure 140 (FIG. 16), a primary coil unit 142 (FIG. 18) and a secondary coil unit 144 (FIG. 19).

Figure 16:
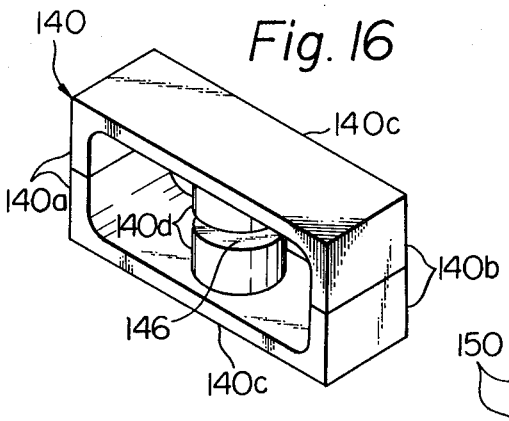
Figure 25:
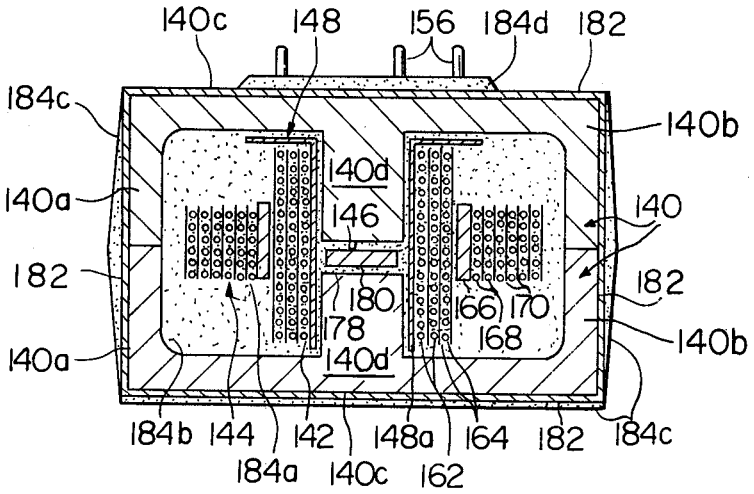

The core structure 140 consists of a pair of generally G-shaped core sections as will be seen from FIG. 16 (or more clearly from FIG. 25). Each of the core sections has a pair of spaced parallel arm portions **140*a* and 140*b* having equal lengths, an intermediate portion 140*c* integrally joining the two arm portions 140*a* and 140*b* at right angles to the arm portions, and a cylindrical land portion 140*d* projecting perpendicularly from the inner face of the intermediate portion 140*c* in parallel with the arm portions 140*a* and 140*b*. The cylindrical land portion 140*d* of one core section has a length substantially equal to the length of the arm portions 140*a* and 140*b* of the core section but the cylindrical land portion 140*d* of the other core section is slightly smaller than the length of the arm portions 140*a* and 140*b* of the section. When, thus, the core sections are fitted to each other with the end faces of the arm portions 140*a* and 140*b* of one core section in contact with those of the arm portions 140*a* and 140*b*, respectively, of the other core section, the end faces of the respective land portions 140*d* of the two core sections are spaced apart a certain distance from each other and form a gap 146 therebetween as will be seen in FIG. 16 or more clearly from FIG. 25. The gap 146 thus formed is intended to prevent magnetic saturation of the core structure 140 and may be sized appropriately depending upon the performance characteristics of the transformer assembly to be obtained. It is apparent that such a gap 146 can be formed if the land 140*d* of both of the core sections are made slightly shorter than the respective arm portions 140*a* and 140*b* of the core sections. While the arm portions 140*a* and 140*b* and the intermediate portions 140*c* of the core sections have generally rectangular cross sections having substantially equal widths and cross sectional areas, the land portions 140*d* of the core sections have circular cross sections having equal diameters which are slightly smaller than the widths of the remaining portions of the core sections. In view, furthermore, of the fact that the flux density usually becomes the smaller in each of the core sections as the magnetic field becomes remoter from the land portion 140*d* of the core section due to the leakage flux produced from the core section, it is preferable that the sum of the cross sectional areas of the arm portions 140*a* and 140*b* of each core section be made smaller than the cross sectional area of the land portion 140*d* of the core section. This is conducive not only to making the magnetic density substantially uniform throughout the magnetic path of the core structure 140 but to reduction of the weight of the core structure 140. In the shown embodiment, the sum of the cross sectional areas of the arm portions 140*a* and 140*b* of each core section is assumed to be about 94 percent of the cross sectional area of the land portion 140*d*** of the core section.

Turning to FIG. 17 and 18, the primary coil unit 142 comprises a bobbin 148 consisting of a hollow tubular portion **148*a* having open ends and a generally flange-shaped portion 148*b* which is formed with first and second sets of radial portions 150. The radial portions 150 of each set are circumferentially spaced apart from each other to form radial gaps 152 therebetween. Each of the radial portions 150 is formed with a through hole 154 extending in parallel with the center axis of the bobbin 148 and open at both ends. A tubular terminal element 156 is closely received in part in each of the through holes 154 and projects axially outwardly from the radial portion 150 in which the hole 154 is formed. The first and second sets of radial portions 150 are spaced in their entireties apart from each other across an open space 158 having a width slightly larger than the width of the core structure 140 or, more exactly, of the intermediate portion 10***c* of each core section. The tubular portion 148*a* of the bobbin 148 has an inside diameter which is slightly larger than the diameter of the cylindrical land portions 148*d* of the core sections and an axial length slightly smaller than the distance between the respective inner faces of the intermediate portions 148*c* of the core sections fitted together. The bobbin 148 thus shaped is formed of a suitable premixed moulding compound of, for example, unsaturated polyester resin added with a suitable reinforcing composition.

The primary coil unit 142 further comprises, as shown in FIG. 18, a winding 160 of a varnish-coated conductor helically wound in layers on the tubular portion 148*a* of the bobbin 148 with insulating films 162 interposed between the individual adjacent layers of the winding 160 to provide layer-to-layer insulation for the winding. The outermost layer of the winding 160 is wrapped in an insulating film 162*a* of preferably the same material as that of the layer-to-layer insulating films 162. The outermost insulating film 162*a* is secured to the outermost layer of the winding 160 by the use of an adhesive tape (not shown) of a heat-resistant, dielectric material such as polyester resin. Taps are suitably brought out of the winding 160 by lead wires 164 for electrical connection to external circuits or circuit elements (not shown). The lead wires 164 are stretched on the outer faces of the radial portions 150 of the flange-shaped portion 148*b* of the above described bobbin 148 and/or through the gaps 152 between the radial portions 150 and are respectively connected through the holes 154 in the radial portions 150 to the tubular terminal elements 156 secured to the radial portions 150. The lead wires 164 are passed throughout the bores in the tubular terminal elements 156 and are preferably soldered at their ends to the open leading ends of the terminal elements 156, though not seen in the drawings.

On the other hand, the secondary coil unit 144 comprises, as shown in FIG. 19, a cylindrical bobbin 166 having an axial bore which is open at both ends. The bobbin 166 has an inside diameter which is slightly larger than the outside diameter of the winding 160 of the primary coil unit 142 and an axial length smaller than that of the primary winding 160. A varnish-coated conductor is helically wound in layers on the bobbin 166 so as to form a winding 168 with insulating films 170 interposed between the individual adjacent layers of the winding 168. The insulating film 170 used in the secondary coil unit 144 may be of the type which is processed to have a surface of mat form. The conductor constituting the secondary winding 168 is connected at its terminal end to a terminal element 172, which is securely held in position on the outer peripheral surface of the secondary winding 168 by means of an adhesive tape 174 of a heat-resistant, dielectric material such as polyester resin. The terminal element 172 is connected to an insulated lead wire 176 for connection to an external circuit or circuit element such as a high-voltage rectifier of the horizontal deflection circuit (not shown) of a television receiver.

As in the case of the embodiment shown in FIGS. 10 to 15, the respective numbers of the layers of the windings 160 and 168 of the primary and secondary coil units 142 and 144 and the numbers of the turns in the individual layers are selected depending upon the desired performance characteristics of the transformer assembly to be obtained.

The core structure 140 and the primary and secondary coil units 142 and 144 thus constructed and arranged are assembled together in the following manners.

Figure 22:
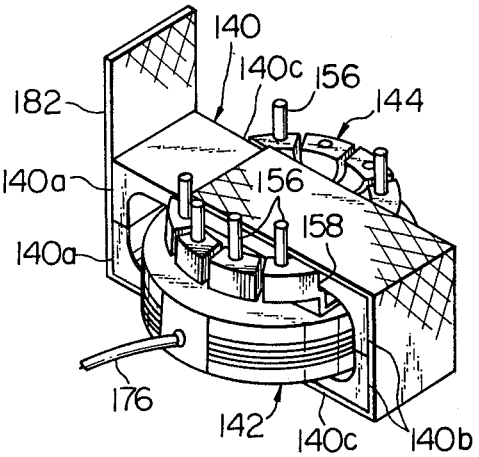
Figure 23:
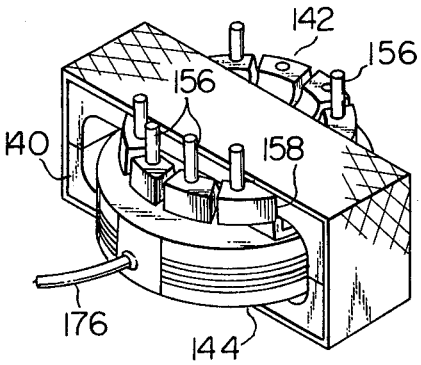

The primary and secondary coil units 142 and 144 are first fitted together in concentric relationship to each other with the primary winding 160 inserted through the axial bore in the cylindrical bobbin 166. The coil units 142 and 144 are secured to each other by means of a suitable adhesive bonding the inner peripheral surface of the cylindrical bobbin 166 to an axially central portion of the outermost insulating film 162*a* on the primary winding 160. The resultant subassembly of the primary and secondary coil units 142 and 144 is illustrated in its entirety in FIG. 20. A suitable metal-to-metal adhesive is applied, in a suitable pattern, onto the end face of the cylindrical land portion 140*d* of each of the core sections as indicated by numeral 178 in FIG. 21. A spacer element 180 of a non-magnetic material is attached to the end face of the land portion 140*d* of each core section by means of the adhesive applied to the end face. It is, in this instance, important that the spacer element 180 have a thickness smaller than the distance of the gap 146 to be formed between the end faces of the land portions 140*d* of the two core sections when the core sections are held together. The subassembly of the coil units 142 and 144 is then mounted on the core sections thus arranged. For this purpose, the respective land portions 140*d* of the two core sections are inserted, either one after another or concurrently, into the axial bore in the tubular portion 148*a* of the bobbin 148 of the primary coil unit 142 so that the arm portions 140*a* and 140*b* of one core section are brought into contact with the arm portions 140*a* and 140*b*, respectively, of the other core section and, furthermore, the intermediate portion 140*c* of one of the core sections is received in the previously mentioned open space 158 between the first and second set of radial portions 150 of the flange-shaped portion 148*b* of the bobbin 148, as seen in FIG. 22. As a consequence, the first and second sets of radial portions 50 are located on both sides of the intermediate portion 140*c* of one of the core sections which are now held together to complete the core structure 140. The end faces of the cylindrical land portions 140*d* of the core sections thus assembled are, therefore, spaced apart from each other across the spacer element 180 and form the previously mentioned gap 146 therebetween as will be seen from FIGS. 25 and 26. The spacer element 180 is securely retained within this gap 146 by means of the layers 178 of the adhesive applied to the end faces of the land portions 140*d*. A strip 182 of a heat-resistant material such as for example acetate fabric is attached by a suitable adhesive to the entire outer faces of the core structure 140 as illustrated in FIG. 22 so as to form a heat-resistant, protective layer covering all the outer faces of the arm portions 140*a* and 140*b* and the intermediate portions 140*c* of the core sections as shown in FIG. 23. While the strip 182 is shown to be substantially equal in width to the core structure 140, the same may be slightly wider so that not only the outer faces of the core structure 140 but the side edges of the portions 140*a*, 140*b* and 140*c* of the core structure are covered by the protective layer if desired.

Figure 24:
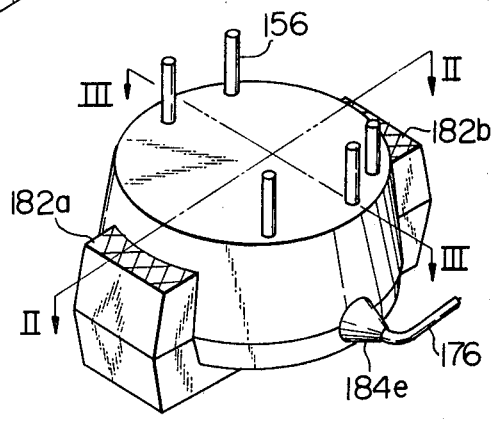
Figure 26:
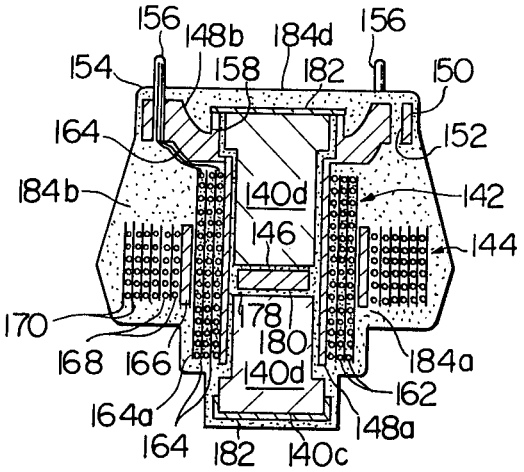

The subassembly of the primary and secondary coil units 142 and 144 and the core structure 140 thus provided with the protective layer 182 is processed in a mould (not shown) so as to form thereon an insulating envelope 184 (FIGS. 24 to 26). The mould to be used for this purpose is formed with a cavity which is configured in such a manner as to accommodate therein the subassembly of the core structure 140 and the coil units 142 and 144 except for the leading end portions of the terminal elements 156 and opposite end portions of the outer faces of the protective layer 182 on the intermediate portions 140*c* of the core structure 140. The subassembly of the core structure and coil units is placed within the mould with the leading end portions of the terminal elements 156 projecting out of the mould and with the above mentioned portions of the protective layer 182 exposed externally of the mould. The mould is then internally heated to a predetermined temperature and is vacuumized to establish therein a partial vacuum lower than about 10 millimeters of mercury. A heat-resistant dielectric material of, for example, silicon rubber of a fluid state is then injected under the pressure of the order of 10 to 20 kgs/cm$^2$ into the cavity of the mould until the cavity is filled up with the material in the presence of the partial vacuum. The mould is kept heated at a predetermined temperature of, for example, about 140° to 150° C for a predetermined period of time of, for example, 2 to 3 minutes. When the injected material in the mould is cured, the subassembly is formed with the insulating envelope 184 which consists of, as shown in FIGS. 25 and 26, a portion 184*a* surrounding the layers of the primary and secondary windings 162 and 168, a portion 184*b* filling up the spaces between the core structure 140 and the subassembly of the coil units 142 and 144, a layer portion 184*c* covering the entire faces of the arm portions 140*a* and 140*b* and the intermediate portion 140*c* opposite to the flange-shaped portion 148*b* of the bobbin 148, a layer portion 184*d* enclosing the flange-shaped portion 148*b* of the bobbin 148, and a projecting portion 184*e* (FIG. 24) wrapping the lead-out portion of the lead wire 176 from the terminal element 172 (FIG. 20) on the secondary coil unit 144. The portion 184*a* surrounding the layers of the primary and secondary windings 162 and 168 not only encapsulates the layers but impregnates the interstices between the layers of the windings 162 and 168 and the insulating films 166 and 170 and between the individual turns of the windings in a porosity-free fashion due to the partial vacuum established in the mould during formation of the insulating envelope 184. The layer portion 184*d* wrapping the radial portions 150 of the bobbin 148 of the primary coil unit 142 fills up the gaps 152 (FIG. 21) between the radial portions and isolates the lead wires 164 stretched on the outer surfaces of the radial portions 150 and/or in the gaps 152. If desired, however, the insulating envelope 184 may be so formed as to be void of the particular portion 184*d* especially if the bobbin 148 is constructed of a sufficiently arc-resistant, fire-proof material. The insulating envelope 184 is, furthermore, absent over those portions of the protective layer 182 which lie on the opposite longitudinal portions of the intermediate portion 140*c* of the core structure adjacent the flange-shaped portion 148*b* of the bobbin 148. The particular portions of the protective layer 182 are therefore exposed externally of the insulating envelope 184 as best seen at 182*a* and 182*b* in FIG. 24.

From the foregoing description it will be appreciated that the present invention provides various prominent advantages in each, some or all of the first embodiment shown in FIG. 8, the second embodiment shown in FIG. 9, the third embodiment shown in FIGS. 10 to 15 and the fourth embodiment shown in FIGS. 16 to 26 as follows:

1. In the absence of a layer of air in the window in the core structure, the dielectric strength between the secondary coil unit and the adjacent portion of the core structure in the first or third embodiment or the adjacent portions of the core structure in the fourth embodiment or the primary coil unit in the second embodiment can be broadly increased to allow reduction of the distance or distances therebetween, contributing to reduction of the total size and weight of the transformer assembly as a whole.

2. Because that portion of the window in the core structure which would be subject to production of a corona discharge is filled up with a solid, void-free dielectric material, there is no danger of a corona discharge being caused through such a portion, assuring safety of operation when the transformer assembly is in use in, for example, a television receiver.

3. The dielectric material intervening between the secondary coil unit and the adjacent portion or portions of the core structure in the first, third or fourth embodiment or the primary coil unit in the second embodiment is an excellent heat conductive substance. The heat generated in the secondary coil unit is therefore dissipated at a high rate into the ambient air through such a material. This will contribute to prevention of the coil units and core structure from being excessively heated during operation and accordingly to deterioration of the dielectric material forming the insulating envelope, providing a prolonged service life of the transformer assembly. Because, furthermore, the dielectric material is highly resistant to heat, there is no need of enclosing the transformer assembly within a fire-proof casing or framework especially in the case of the third or fourth embodiment in which the subassembly of the core structure and coil units is totally or in a major proportion enclosed by the insulating envelope 138 or 184. This will lessen the space for the installation of the transformer assembly in a television receiver.

4. The dielectric material impregnating the layers of the windings and insulating films therebetween is integral with the dielectric material encapsulating the windings in every embodiment. Production of a creeping discharge between the encapsulating layer of the dielectric material and the ends of the layer-to-layer insulating films at the axial ends of each coil unit can be completely precluded.

5. The subassembly of the core structure and coil units is placed in its entirety within a mould during formation of the insulating envelope thereon in the case of the third or fourth embodiment. The lead wires connected between the coil units and the terminal elements are, therefore, totally enclosed within the mould and, for this reason, there is no need of treating the lead wires before and after the moulding operation for the prevention of breakage of the lead wires or removal of a surplus material that tends to be deposited on the wires as required in a prior art method. This will reduce the number of steps to be taken for the manufacture of the transformer assembly.

6. The lead wires are, furthermore, completely embedded in the insulating envelope in the third or fourth embodiment. The lead wires are, therefore, not only electrically but mechanically isolated from one another so that, even though the lead wires may be located close to each other, there will be no danger of insulation breakdown or production of corona discharge therebetween. The dielectric material enclosing the bobbin fills up the gaps between the radial portions of the bobbin carrying the terminal elements to which the lead wires are connected. No creeping discharge will therefore be caused between the individual radial portions which are thus spaced apart from each other across the layers of the dielectric material.

7. Not only the lead wires but the bobbin carrying the terminal elements is completely embedded in the insulating envelope in the third or fourth embodiment shown. The bobbin in its entirety is thus perfectly isolated from the dust in air and can therefore be prevented from producing arc or sparkover between the terminal elements which are subject to considerable potential differences.

8. If the insulating envelope as in the third or fourth embodiment is formed of silicon rubber or any other dielectric material having resiliency, then the envelope will serve as vibration absorbing means effective to prevent the transfer of mechanical vibrations from the core structure to any support member, such as a printed circuit board for the transformer assembly, eliminating unpleasant noises that would otherwise be produced between the support member and the transformer assembly or any other circuit element or elements that may be mounted on or contacted by the support member. Furthermore, that portion of the insulating envelope which encapsulates and impregnates the primary and secondary windings in each of the first to fourth embodiments will lend itself to dampening out, to some degree, the vibrations resulting from the generation of impulses in the windings.

For some of the reasons above itemized, the size and weight of the transformer assembly according to the present invention can be significantly reduced from those of prior art transformers, particularly, flyback transformers and is, thus, adapted to be mounted on a printed circuit board when the transformer assembly is to be installed in, for example, a television receiver. Because, furthermore, of the significantly reduced overall size and weight as above noted, the restrictions in locating the transformer assembly in a given electric or electromagnetic system can be greatly alleviated. The transformer assembly can therefore be located in any place that is most convenient from the design considerations and without recourse to provision of a space-taking shield element or spacing a neighbouring circuit element from the transformer assembly. The printed circuit board for use with the transformer assembly may therefore be of a usual small-sized configuration adapted for installation in a limited space. By reason of the reduced weight, the transformer can be easily and securely fixed to a printed circuit board simply by soldering the terminal elements of the assembly to the board through the holes formed in the board. Because no such metal fasteners as bolts and nuts are thus used for mounting the transformer assembly on the printed circuit board, the transformer assembly is capable of providing performance characteristics which are free from noises that would otherwise result from loose connection between the core structure and the metal fasteners or between the metal fasteners and a support member or such losses that would otherwise be eddy currents produced in the metal fasteners.

In addition to the above described advantages which are achieved in any or all of the embodiments herein illustrated, the following advantages can be obtained in the fourth embodiment of the present invention.

9. Because of the fact that the sections of the core structure 140 are so shaped that the sum of the cross sectional areas of the arm portions 140*a* and 140*b* of each core section is smaller than the cross sectional area of the cylindrical land portion 140*d* surrounded by the primary and secondary coil units 142 and 144, the magnetic flux density is substantially constant throughout the core structure 140 and, furthermore, the weight of the core structure can be reduced to a considerable extent.

10. Being constructed as a shell-type transformer having return paths of the flux located externally of the subassembly of the coil units received on the central land portions 140*d* of the core structure 140 which is formed with only one gap 146 between the land portions enclosed by the subassembly, the leakage flux produced from the core structure 140 is far lesser than that produced in prior art transformers of, for example, the type illustrated in FIGS. 1 to 3 or FIGS. 4 to 6. If, therefore, the transformer assembly provided by the present invention is placed in the neighbourhood of the cathode-ray tube of a television receiver, there will be no such danger that the electron beams in the cathode-ray tube are unduly deflected by the leakage flux from the transformer. Because, furthermore, the induced magnetic field directed outwardly of the subassembly of the coil units 142 and 144 is shielded by the arm portions 140*a* and 140*b* of the core structure, leakage of flux in the longitudinal direction of the core structure 140 is completely eliminated. Any circuit or circuit element which is susceptible to leakage flux from an external source may be located in alignment with such a direction.

11. When the subassembly of the coil units and the core structure is being fitted to or withdrawn from a mould prior to or upon completion of the formation of the insulating envelope 184, the protective layer 184 covering the outer faces and, if desired, the side edges of the core structure 140 protects the mould from being scratched or violently hit by the core structure. If, furthermore, the sections constituting the core structure 140 fail to be firmly fitted to each other by the adhesive applied between the land portions 140*d* thereof when the subassembly of the coil units and the core structure is being fitted to, held in position in or removed from the mould, the sections can be securely held together by the protective layer 182 which also serves as a retaining strip for the core sections.

12. The inductance to be achieved by a transformer usually varies irregularly from one transformer to another depending upon the conditions in which the core sections are fabricated and upon the dimensions of the core sections because of the fact that the behaviours of a core structure are dictated by the pressures exerted on the blanks to form the core sections by the temperature and chemical composition of the atmosphere in a baking oven to bake the blanks. In the embodiment of the transformer assembly shown in FIGS. 16 to 26, the inductance of the transformer assembly can be precisely controlled by varying the gap 146 between the land portions 140*d* of the core sections during production of the core sections.

While present invention has been described and shown as being applied to transformer arrangements using the combinations of core sections having generally U-shaped or E-shaped sections, it is apparent that the basic features of the invention can be realized in any transformer arrangements using an open-type core structure having a generally U-shaped or E-shaped section or a split-type core structure using the combination of core sections having E-shaped and I-shaped sections or any sections otherwise shaped.

What is claimed is:

1. A transformer assembly comprising a ferromagnetic core structure comprising two generally E-shaped core sections each consisting of a pair of spaced parallel arm portions, an intermediate portion integrally joining said arm portions together and a cylindrical land portion projecting from said intermediate portion substantially in parallel with said arm portions and located intermediate between said arm portions, said core sections being held together with the end faces of the arm portions of one of the core sections respectively in contact with the end faces of the arm portions of the other core section, the respective land portions of the two core sections having end faces which are spaced apart from each other to define a gap therebetween, primary and secondary coil units each including at least one winding arranged in layers and having at least two lead wires, the primary coil unit comprising a bobbin including a tubular portion having open axial ends and a plurality of radial portions projecting radially outwardly from one of said open axial ends and circumferentially spaced apart from each other to define gaps therebetween, each of said radial portions having connected thereto a terminal element projecting axially outwardly from each radial portion, the winding of the primary coil unit being mounted on said tubular portion and concentrically supporting the secondary coil unit thereon, each of said lead wires except for a high-voltage lead wire for the secondary coil unit being connected to each of the terminal elements on said radial portions through each of said gaps, said primary and secondary coil units being mounted on said core structure substantially in concentric relationship to said land portions of said core sections with said land portions received in said tubular portion of said bobbin, and a unitary void-free insulating envelope of a heat-resistant, elastic dielectric material impregnating the interstices between the turns and layers of the windings of said coil units, totally encapsulating the coil units and filling all the spaces between said core structure and said coil units with leading end portions of said lead wires projecting outwardly from said envelope.

2. A transformer assembly as set forth in claim 1, in which each of said radial portions of said bobbin is formed with a through hole extending in axial direction of the bobbin and has secured thereto the terminal element through said through hole, each of said lead wires being connected to each terminal element through said through hole.

3. A transformer assembly as set forth in claim 1, in which the land portion of one of said core sections is substantially equal in length to the arm portions of the core section and the land portion of the other core section is shorter than the land portion of the former core section for defining said gap between the respective end faces of land portions of the two core sections.

4. A transformer assembly as set forth in claim 1, in which the land portion of one of said sections is substantially equal in length to the arm portions of the section and the land portion of the other section is shorter than the land portion of the former section for forming said gap between the land portions.

5. A transformer assembly as set forth in claim 1, further comprising a spacer element fixedly positioned within said gap between said land portions and encapsulated in said insulating envelope.

6. A transformer assembly as set forth in claim 1, in which said radial portions of said bobbin are arranged in two groups which are located on both sides of the intermediate portion of one of said core sections.

7. A transformer assembly as set forth in claim 1, further comprising a heat-resistant insulating layer of fabric closely attached to the entire outer faces of said core sections and firmly holding the core sections together.

8. A transformer assembly as set forth in claim 7, in which said insulating envelope has a portion covering the outer face of at least a portion of said insulating layer of fabric.

9. A transformer assembly as set forth in claim 1, in which said dielectric material comprises silicon elastomer.

10. A transformer assembly as set forth in claim 1, in which said insulating envelope has said core structure, said coil units and said insulating layer of fabric totally encapsulated therein with an exception of portions of said insulating layer of fabric.

* * * * *